US008621786B2

(12) United States Patent
Lam

(10) Patent No.: US 8,621,786 B2
(45) **Date of Patent: *Jan. 7, 2014**

(54) EFFICIENT LAYOUT AND DESIGN OF PRODUCTION FACILITY

(76) Inventor: Wei Chak Joseph Lam, Singapore (SG)

( * ) Notice: Subject to any disclaimer, the term of this patent is extended or adjusted under 35 U.S.C. 154(b) by 1346 days.

This patent is subject to a terminal disclaimer.

(21) Appl. No.: 10/248,729

(22) Filed: Feb. 13, 2003

(65) Prior Publication Data

US 2004/0159051 A1 Aug. 19, 2004

(51) Int. Cl.
*E04H 3/04* (2006.01)
*E04H 1/00* (2006.01)

(52) U.S. Cl.
USPC ..... 52/33; 52/79.1; 52/174

(58) Field of Classification Search
USPC ..... 52/79.1, 79.6–79.8, 33, 36.1, 174, 82
See application file for complete search history.

(56) References Cited

U.S. PATENT DOCUMENTS

| | | | | |
|---|---|---|---|---|
| 2,154,897 | A * | 4/1939 | Grant | |
| 2,604,670 | A | 7/1952 | Horowitz et al. | |
| 3,341,428 | A | 9/1967 | McManus | |
| 3,395,502 | A * | 8/1968 | Frey | |
| 4,429,501 | A | 2/1984 | de Brabant | |
| 4,612,741 | A * | 9/1986 | Jacobson | 52/79.4 |
| 5,050,354 | A * | 9/1991 | Vendramini | 52/80 |
| 5,076,205 | A * | 12/1991 | Vowles et al. | 118/719 |
| 5,186,718 | A * | 2/1993 | Tepman et al. | 29/25.01 |
| 5,355,395 | A | 10/1994 | Kenneth et al. | |
| 5,632,859 | A | 5/1997 | Heitto et al. | |
| 5,795,356 | A * | 8/1998 | Leveen | 29/25.01 |
| 5,809,708 | A | 9/1998 | Greer et al. | |
| 5,860,258 | A * | 1/1999 | Faith et al. | 52/236.2 |
| 6,099,599 | A | 8/2000 | Wu | |
| 6,216,398 | B1 * | 4/2001 | Shipman et al. | 52/36.1 |
| 6,360,494 | B1 | 3/2002 | Emerson | |
| 6,640,878 | B2 | 11/2003 | Allor et al. | |
| 2002/0046518 | A1 * | 4/2002 | Eguchi et al. | 52/220.1 |
| 2002/0193972 | A1 * | 12/2002 | Kudo et al. | 703/1 |
| 2007/0244594 | A1 * | 10/2007 | Chik et al. | 700/112 |

FOREIGN PATENT DOCUMENTS

| | | | |
|---|---|---|---|
| JP | 4-240714 | * | 8/1992 |
| JP | 07317346 | A | 12/1995 |
| JP | 8003280 | B | 1/1996 |
| JP | 11-176712 | | 7/1999 |
| JP | 2002-070345 | | 3/2002 |
| NL | 45940 | C | 6/1939 |

OTHER PUBLICATIONS

Feld, William M., Lean Manufacturing: Tool, Techniques, and How to Use Them, 2001, St.Lucie Press, p. 74.*
Benaafar, S., Heragu, S.S. and Irani, S., Next Generation Factory Layouts, 2001, Regents of University of Minnesota, p. 12.*

* cited by examiner

*Primary Examiner* — Joshua J Michener
*Assistant Examiner* — Elizabeth A Plummer
(74) *Attorney, Agent, or Firm* — Horizon IP Pte. Ltd.

(57) ABSTRACT

An improved layout for a manufacturing facility is disclosed. The layout includes a production area which includes a hub which is at least partially surrounded by a production corridor. The production corridor comprises production stages used in the manufacturing process. The hub, having direct line-of-sight to the production stages, can easily monitor the manufacturing process.

13 Claims, 6 Drawing Sheets

201

EFFICIENT LAYOUT AND DESIGN OF PRODUCTION FACILITY

This application is a continuation-in-part of U.S. application Ser. No. 10/172,327, filed Jun. 14, 2002.

BACKGROUND OF INVENTION

Ideally, the layout of a manufacturing facility should promote efficient flow of work and people. Additionally, the layout should facilitate production, production control, and quality control. For example, the layout should be configured to facilitate quality assurance to minimize defects and operation difficulties, thus ensuring manufacturing and product quality. Quality initiatives also should be built into the facility. This is essential and particularly important for the pharmaceutical manufacturing industry which operates under a strict regulatory environment.

In the United States, the pharmaceutical manufacturing industry must comply with "Current Good Manufacturing Practices" (CGMP) promulgated by the Food and Drug Administration (FDA). See 21 CFR §§210-226. Other regulations or guidelines which the pharmaceutical industry may be subjected to include, for example, World Health Organization GMP guidelines and Pharmaceutical Inspection Co-operation Scheme (PICS).

CGMP defines requirements with which a drug manufacturing facility and process must comply. This includes for example, having the building and facility suitably designed and constructed to facilitate cleaning, maintenance and proper operations. A controlled environment must be provided with barriers to control dust, temperature, and humidity to prevent contamination. See 21 CFR §211.42 and PICS 5.19. The flow of components and defined areas should be configured to prevent mix-ups and contaminations. See 21 CFR §211.42(b)(c). Also, equipment should be suitably located to facilitate operations for each intended use as well as cleaning and maintenance. See 21 CFR §211.63. These are just some of the myriad of requirements under CGMP.

Non-conformity with CGMP renders a drug "adulterated" under the Food, Drug and Cosmetics Act. See 21 USC §501(a)(2)(B). A drug is deemed adulterated "if the methods used in, or the facilities or the controls used for its manufacture, process, packing or holding do not conform to or are not operated or administered in conformity with CGMP." The purpose of 21 USC §501(a)(2)(B) is to protect public interest, by ensuring that the drugs marketed meet its regulated claims specifications. To prevent a drug product from being deemed adulterated, a total quality control, approach and system is necessary. A failure to comply with any regulations may result in the drug being withdrawn from the market, as well as subjecting the manufacturer to sanction. This places a heavy burden on the manufacturer to ensure compliance with CGMP.

However, ambiguity in the language of the statute subjects it to interpretation and imparts uncertainty about the requirements for compliance. For example, compliance is not ensured even though the quality manufacturing process or engineering facility is considered "average" compared to the industry. This is because compliance with the regulations requires that a pharmaceutical product must be manufactured by current good manufacturing practice methods, controls and system in order to protect the public. The absence of a consistent and widely accepted interpretation of some of regulatory requirements has led to increased cost in engineering new facilities. This has also led to longer lead-times in engineering and, in some cases, delays in bringing new pharmaceutical products to market. In an attempt to clarify the regulatory requirements, the International Society for Pharmaceutical Engineering and the FDA have cooperated to publish a Baseline® Pharmaceutical Engineering Guide (Guide).

The Guide includes suggestions from the FDA for compliance with CGMP. The main basic philosophy promoted by the Guide is "Good Engineering Practice" (GEP), which is defined as "established engineering methods and standards that are applied throughout the project life cycle to deliver appropriate and cost effective solutions". It takes into account the design and installation of facilities and equipment and takes "full account of CGMP, safety, health, environmental, ergonomic, operational, maintenance, recognized industry guidance, and statutory requirements". See Guide. In addition to protecting the integrity of the drugs, the safety of the operators and visitors must be considered in the engineering design.

FIG. 1 shows a layout of a conventional pharmaceutical manufacturing facility 101. As shown, the facility comprises a rectangular shaped building with two levels 103*a* and 103*b*. Typically, the production area 140 is located on the ground level 103*a* while non-production areas are located on the second level 103*b*. Also located on the ground level are storage area 195, and packing area 197. Additional areas, such as changing area 194, cafeteria 191, engineering area 193 can also be included on the ground level. The non-production areas on the second level include administration area 108, laboratory area 141, storage area 145, and HVAC plant room 146. In some facilities, all the different areas are provided in a single level.

The various production suites 165 form different stages of a production line for manufacturing pharmaceutical products. Products are tested in their various stages for quality control. The finished products are transferred to the packing area for packaging and then to the storage area.

Although such a layout may comply with CGMP, it is, however, inefficient. For example, quality assurance and quality control cannot be easily carried out in such conventional layouts. The different production stages are not visible from a single point, making it inconvenient to monitor, identify, and verify the manufacturing process. Such deficiencies increase process time in identification and quality monitoring. Therefore, a manufacturer incurs additional costs to ensure that the process can be monitored adequately for verification and quality control, rendering such layouts not cost effective.

From the foregoing discussion, it is desirable to provide a more efficient and cost effective layout for a manufacturing facility.

SUMMARY OF INVENTION

The invention relates to an improved layout for a manufacturing facility. In one embodiment, the layout includes a production area having a hub which is at least partially surrounded by a production corridor comprising a plurality of production stages. The production stages are visible from the hub, enabling the manufacturing process to be monitored therefrom. In another embodiment, a technical corridor surrounds the production corridor. The facility corridor can be used for servicing and maintaining the production equipment, such as through-the-wall technology type equipment. Additionally, the technical corridor can also serve as a buffer zone to reduce the influence of external building conditions on the production corridor.

In another embodiment of the invention, the layout includes a production support area. The production support area can be located, for example, on one side of the production area. Functions which support production include, for example, those which facilitate the flow of materials from delivery to production area for processing and processed products from the production area to delivery to customers. Non-production functions can also be located in the production area.

In accordance with various embodiments of the invention, the layout is designed to comply with CGMP as well as other regulatory and quality requirements. The layout facilitates production and cleaning processes, and movement of people and products. Furthermore, the layout enables the phase of processing to be easily and cost-effectively monitored, identified and verified for greater efficiency in records, quality process control, quality assurance and regulatory compliance with CGMP.

DETAILED DESCRIPTION

Figure 1:
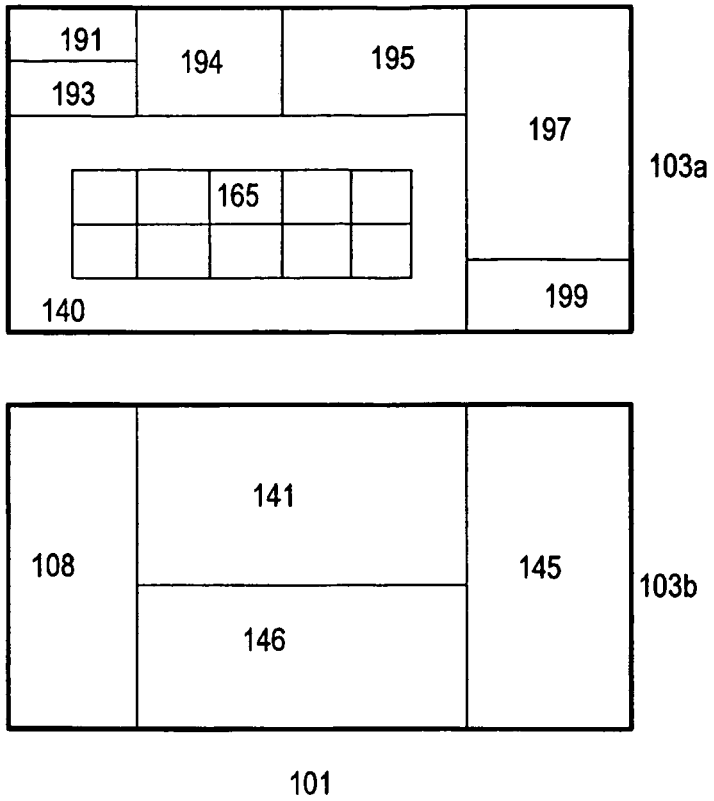
FIG 1 Prior Art
FIG. 1 shows a conventional layout of a production facility.
Figure 2:
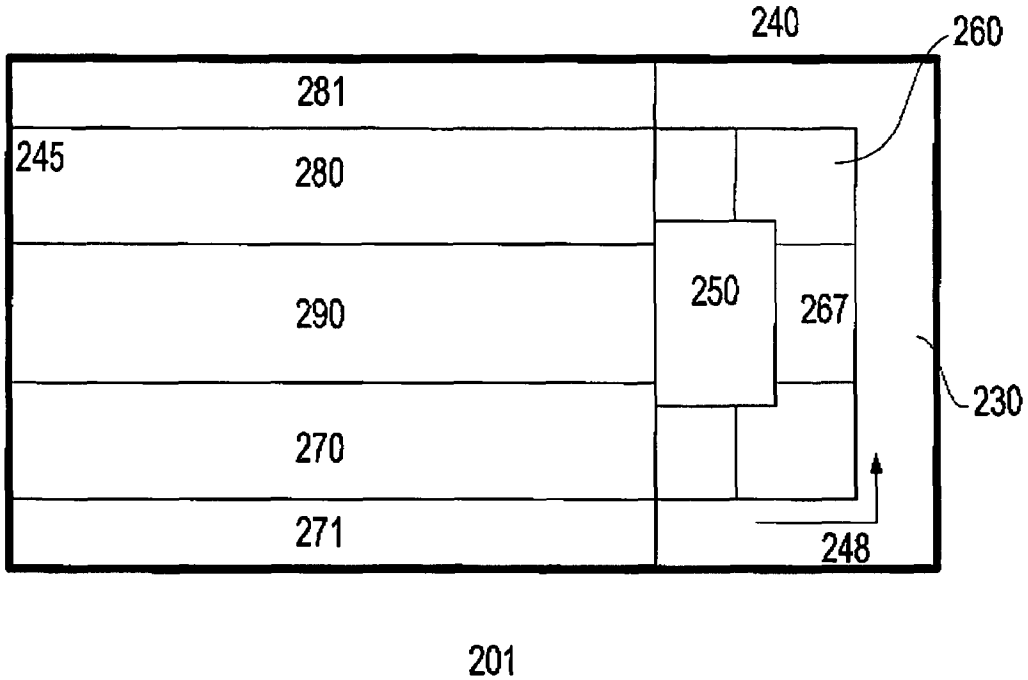
FIG. 2 shows a layout of a production facility in accordance with one embodiment of the invention.

FIG. 2 shows a building 201 of a production facility in accordance with one embodiment of the invention. Illustratively, the building is depicted as having a rectangular shape. Other geometric shapes are also useful. In one embodiment, the building comprises production and production support areas 240 and 245. As shown, the production area is located on one side of the building while the production support area is located on the other side. Other configurations of production and production support areas are also useful. For example, the production support area can be located on opposite sides of the production area. One or more pathways or corridors can be provided to interconnect sections of the production support areas, if desired. Alternatively, the production support area can be located on different sides, partially or fully surrounding the production area. For example, the production support area can surround two adjacent, three, or all sides of the production area.

In another embodiment, the production and production support areas can be located on different levels of the building. For example, the building can comprise first and second levels, with the production area in the first level and the production support area on the second level. Providing a building with more than two levels is also useful. The first level is, for example, the lower level. The first level can also be the top level. Providing a layout in which the production and production support areas are located on different levels advantageously reduces the building's footprint (e.g., size of building). Expansion can be achieved by adding additional levels, as needed. Alternatively, expansion can be achieved by enlarging the building's footprint. In another embodiment, the production and production support areas can be located in different buildings. The different buildings can be interconnected by pathways or linkways. Such configurations are described in co-pending patent application U.S. Ser. No. 10/172,327, titled "Layout of Production Facility", which is herein incorporated by reference for all purposes. The production area, as shown, is rectangular in shape. Providing the production area with other shapes are also useful. Hub 250 and production corridor 260 are provided in the production area. As shown, the hub comprises a rectangular shape. Providing a hub with other geometric shapes is also useful. For example, the hub can comprise a circular, semicircular, octagonal, semioctagonal, or a combination of different geometric shapes. In one embodiment, a portion of the hub abuts the boundary of the production area. Preferably, the portion of the hub abuts the boundary of the production area which is contiguous or adjacent to the production support area. Providing a hub which does not abut the boundary of the production area is also useful.

In one embodiment, the production corridor partially surrounds the hub. Preferably, the production corridor surrounds the hub except the portion abutting the boundary of the production area 240. Providing a production corridor surrounding the hub completely is also useful. Alternatively, the production corridor can be separated into distinct sub-production corridors that partially or fully surround the hub. It is understood that the production subcorridors need not be continuous. The production corridor comprises a plurality of processing stages used in the manufacturing of one or more products. A processing stage can be used to perform one or more steps in the manufacturing process. For example, stages are used to perform front-end and back-end processes. Providing stages to perform back-end or back-end and front end processes is also useful. The processing stages can form one or more production lines used to form one or more products. Some stages, for example, can be duplicated as desired.

The sequence of the production stages are preferably arranged to optimize the production process. In one embodiment, the stages are arranged to facilitate flow of work from stage to stage, to the extent possible, in sequence. For example, the sequence of production stages are arranged to facilitate process flow in a counter-clock wise direction, as shown by arrow 248. Arranging the production stages to facilitate process flow in a clockwise direction is also useful. Other flow arrangements for the production stages are also useful.

In accordance with one embodiment of the invention, the production stages are visible from the hub (i.e., a direct line-of-sight from the hub). If the hub is physically separated from the production corridor, the barriers used to separate the hub from the corridor should be at least partially transparent to allow the production stages to be visible from within the hub.

Manufacturing data from the processing stages, in one embodiment, are transferred to the hub. This can be performed in real time or after each process is completed. For example, communication links are provided to one, some, or all the production stages. Manufacturing information is transferred via the communication links to the hub. Thus the hub serves as a control area or center, enabling the manufacturing process to be monitored, identified, and verified easily and efficiently therefrom.

In another embodiment, the hub comprises at least first and second levels. One of the levels serves as the control center or control hub while the other level can serve as a workflow hub or circle corridor. The workflow hub facilitates flow of products and/or people in the production corridor. Additionally, the workflow hub can serve as a staging area, work in process storage area and/or support utility area. The workflow hub, for example, can be physically a part of the production corridor.

In one embodiment, a laboratory can be provided in the workflow hub for testing of the products at various stages of production. Providing the laboratory at the center allows convenient access from the production stages, increasing manufacturing efficiency. Barriers can be provided, if necessary, to avoid commingling with the production area. The control area is preferably located above the workflow hub. Locating the control area below the workflow hub is also useful. Additional levels can be provided in the hub as desired.

The production corridor can be enclosed in an environmentally controlled area (e.g., clean room) to maintain, for example, temperature, humidity, and air quality within desired limits. A controlled environment is particularly useful for manufacturing, for example, pharmaceutical products. The clean room environment is also useful for manufacturing other types of products, for example, semiconductors, chemical products, food processing, biotechnical products. Various types of production stages for manufacturing pharmaceutical products include, for example, dispensing, mixing, capsule filling, tableting and coating.

To minimize or reduce flow of people or materials in and out of the clean room, the control hub is preferably physically separated from the production corridor. Alternatively, the production corridor can be a non-clean room environment for manufacturing products which do not require a controlled environment. For example, non-clean room environment can be useful for manufacturing paper or food products.

The production corridor can be separated into segments 267, each comprising one or more production stages. The segment can be in different shapes and sizes, even comprises of other corridors and segments. In one embodiment, the segments are physically separated by barriers. Preferably, the segments are completely separated by barriers to create production rooms. The rooms may be in different sizes and shapes. Doors, interlocking rooms, and/or openings are used to provide access to the production rooms. Preferably, at least the portion of the barrier facing the hub is transparent. More preferably, the barriers are transparent, enabling visible communication between the segments as well between the hub and segments. An access path can be provided between the hub and the production corridor to facilitate flow of people and materials, or products from segment to segment. For an environmentally controlled production facility, the access path is preferably part of the clean room or controlled environment. Where a workflow hub is provided, it is preferably part of the controlled environment. Providing a workflow hub which is not part of the controlled environment is also useful.

Segmenting the production corridor adds flexibility to the production facility. For example, a segment can be upgraded individually without impacting the other segments. Furthermore, a segment can be expanded individually to increase its capacity by extending the outer barrier without affecting the other segments.

In another embodiment, the production corridor is arranged in first and second levels. The additional levels increase capacity without increasing area (e.g., footprint). Providing a production corridor with more than two levels is also useful. In accordance with one embodiment of the invention, the production corridor comprises a first and a pseudo second level. The levels, for example, are not physically or completely physically separated. Providing levels which are physically separated is also useful. Bins (e.g., intermediate bulk containers (IBCs) or other types of containers) can be located in the upper level. A bin, for example, contains raw materials or partially processed products (generally referred to as processing material) which will be charged or fed to an equipment or a process operation in a production stage for processing. Other techniques for charging, such as vacuum techniques, are also useful. After processing is completed, the processed material is discharged to a bin for transport to either another stage for further processing, testing or packaging. In one embodiment, the charging and discharging are performed outside of the production corridor. Performing charging and/or discharging inside or a combination of inside and outside of the production corridor is also useful.

In one embodiment, a technical corridor 230 surrounds the production corridor in the production area. In one embodiment, the technical corridor is between the production corridor and the boundary of the production area. The technical corridor can be in any shape and size. Preferably, the technical corridor comprises first and second levels. The first and second levels, for example, correspond to the first and second or pseudo second levels of the production corridor. Providing the technical corridor with additional levels or other sections within the technical corridor is also useful.

The technical corridor includes, for example, staging areas or other areas to support production. To reduce or avoid contamination of materials due to servicing or maintenance of equipment used in the manufacturing process, through-the-wall equipment is used. Such types of equipment are designed to be serviced through a wall outside the production corridor. In one embodiment, equipments in some or all the production stages are located against the outer wall of the production corridor. The technical corridor can include cleaning areas for cleaning such through-the-wall type of equipment. Additional areas for maintaining the equipment can also be included in the technical corridor. Also, the technical corridor can include one or more cleaning areas for cleaning bins or other equipment. Generally, the technical corridor is non-environmentally controlled area. If necessary, a portion or the whole technical corridor can be part of the environmentally controlled area.

The technical corridor can also facilitate movement of container, bins, and/or carrier devices from stage to stage as well as level to level. In one embodiment, the technical corridor includes a transport area or subcorridor for facilitating the movement of the containers or other carrier devices between the stages and/or levels. The transport area is preferably adjacent to the production corridor. It is understood that the transport area need not be physically separated in the technical corridor.

The production support area 245 comprises, for example, sections for storage, packing, quality testing, inspection, receiving materials, material preparation, and dispatching products or material. Additional sections for non-production functions, such as for changing, eating, engineering, administration, security, meeting and offices can also be included in the production support area. Sections for other types of production or production support functions can also be included in the production support area. Preferably, the areas are arranged to optimize flow of material to and processed products from the production area.

In one embodiment, the production area comprises inflow and outflow corridors 270 and 280. The inflow corridor comprises preprocessing sections (e.g., receiving, testing, storing, and preparing materials for processing in the production corridor). The outflow corridor comprises postprocessing sections (e.g., receiving, testing, packaging, and storing finished products). Additional sections that serve other functions can also be provided in the inflow and outflow corridors as needed. The various sections of the inflow and outflow corridors are arranged to optimize flow of material into and processed products out of the production corridor.

An inflow and outflow support corridors 271 and 281, in one embodiment, can be provided. The inflow support corridor includes sections that support the flow of material from the point of delivery to processing in the production area. Such sections include, for example, support storage. Other sections, such as waste storage and collection, rejected material storage, can also be included. The outflow support corridor comprises sections that support the flow of processed material from the production corridor for delivery to customers or distributors. For example, sections for storage of packaging supplies, support for packaging, packaging office, and packaging inspection. Other sections which serve other functions can also be included.

In one embodiment, the inflow and inflow support corridors are contiguous. Likewise the outflow and outflow support corridors are contiguous. Preferably the support corridors are located between the main corridors and the boundary of the production support area. Providing support corridors which are not contiguous to main corridors are also useful. In another embodiment, the main corridors include sections which serve the functions of support corridors.

Preferably, the inflow and outflow corridors serve as an extension of the production corridor in the production area. The inflow and outflow support corridors serve as an extension of the technical corridor of the production area. The inflow corridor, for example, abuts the portion of the production corridor at the beginning of the process flow and the outflow corridor abuts the portion of the production corridor at the end of the process flow. The inflow and outflow support corridors abuts the technical corridor. In one embodiment, the inflow, inflow support production, outflow and outflow support corridors create a U shaped flow. Arranging the various corridors, areas, and sections therein to have other flow shapes, such as straight line, is also useful. Additionally, security areas can be provided at the beginning and end of the process flow (e.g., beginning of the inflow and outflow corridors).

A support corridor 290 can also be provided in the production support area. The support corridor can be of any shape and size. In one embodiment, the support corridor is adjacent to the inflow and outflow corridors. Preferably, the support corridor is located between the inflow and outflow corridors, creating a spine in the production support area. The inflow and outflow corridor can be connected at the end opposite the production area, creating a u-shaped inflow/outflow corridor which surrounds the spine. Alternatively, or additionally, passageways that connect the inflow and outflow corridors can be provided along the spine. Likewise, the inflow and outflow support corridors can be coupled. Alternatively, only one of either the support or main corridor sets is connected.

The spine, for example, is an extension of the hub in the production area. An entrance to the building can be located on an end of the spine opposite the end abutting the production area. The entrance preferably is a secured entrance to prevent unauthorized entrance to the building. Locating the entrance in other parts of the spine can also be useful. The spine, for example, serves as a point of entry to the building. Flow of material and people to other sections of the facility are facilitated by the spine.

In one embodiment, the spine can include areas for critical control and monitoring processes which preferably are closely located to the production processes, such as quality control or test laboratory, to enhance quality control and assurance. Preferably, one or more view sub-corridors can be provided in the support corridor, providing a direct line of view to, for example, the packaging, finished product, and/or other areas which require to or should be monitored. Other supporting functions can also be located in the spine. For example, changing area or other areas can be provided. Sections which facilitate access to the production corridor as well as the inflow and outflow corridors are also useful.

In one embodiment, the spine comprises first and second levels. The first or lower level comprises, for example, an entrance to the building as well as areas for critical control and monitoring processes, such as quality control or test laboratory, to enhance quality control and assurance. The second level preferably includes a view sub-corridor, providing a direct line of view to, for example, the packaging, finished product, and/or other areas which require to or should be monitored. In one embodiment, first and second sub-view corridors are provided, with support sections therebetween. Other supporting functions can also be located in the second level of the spine. For example, a changing area or other areas can be provided. Areas which facilitate access to the production corridor as well as the inflow and outflow corridors are also useful.

Preferably, the production support area comprises first and second levels. This enables more efficient use of space to house the various sections of the production support area. The first level comprises inflow and outflow corridors separated by a first level of the spine. Inflow and outflow support corridors can also be provided. The second level can include support functions, such as changing room, meeting rooms, offices, research and development offices, one or more stairwells and/or elevator to enable or facilitate movement between the levels.

Although the production and production support areas are described as separate areas physically separated by a boundary, providing production and production support areas which are partially or fully integrated together is also useful. For example, a boundary between the production and production support areas can be provided for none, one, some, or all of the levels of the production facility.

Figure 3:
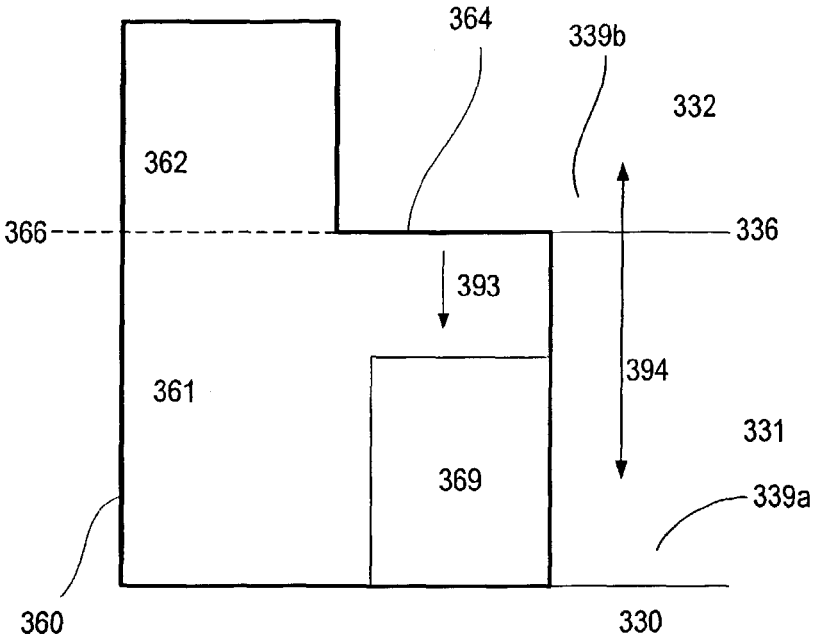
FIG. 3 shows a cross-section of a production corridor in accordance with one embodiment of the invention.

FIG. 3 shows a cross-sectional view of a production corridor 360 in accordance with one embodiment of the invention. The production corridor is part of the environmentally controlled area. In one embodiment, the production corridor comprises a first level 361 and a second pseudo level 362, delineated by the dotted line 366. A technical corridor 330 surrounds the production corridor. The technical corridor, in one embodiment, comprises first and second levels 331 and 332 corresponding to the levels in the production corridor. Unlike the production corridor, a floor 336 physically separates the levels of the technical corridor. Providing technical corridor with one level or additional levels is also useful. In one embodiment, transport areas 339*a-b* are provided in the technical area, located adjacent to the production corridor.

In accordance with one embodiment of the invention, the wall of the second pseudo level adjacent to the technical corridor is inset with respect to the first level. This creates a step 364 in the cross-section. The equipment 369 in a production stage is located below the inset. Preferably, the equipment is located against the wall of the production corridor adjacent to the technical corridor, facilitating maintenance of the equipment in the technical corridor. It is understood that not all stages of the production corridor need to have the wall in the second level adjacent to technical corridor inset with respect to the first level.

A bin containing material or product to be processed (e.g., processing material) can be moved to the step area in the transport area in the second level of the technical corridor above the equipment. The processing material can be charged (e.g., delivered) into the production stage below. The processing material, for example, fills the equipment of the processing stage for processing, as indicated by arrow 393. Alternatively, the processing material is used in a process operation. After processing is completed, the processed material is dispensed (e.g., sent) to a bin, for example, in the transport area 339*a* outside of the production corridor, as indicated by arrow 394.

To facilitate charging and dispensing material into and out from the production stages, inflow and outflow docks can be used. The docks are appropriated located, for example, in the step area and on the walls of the production corridor adjacent to the technical corridor. The bins or containers used for transport of materials can also mated to the docks, with valves with enable the transfer of material. The valves, for example, are hydraulically or pneumatically controlled. The valves and docks sever to maintain the integrity of the controlled environment of the production corridor.

The bin can be moved to another production stage for further processing, testing or packaging (if processing of the product is completed). Lifts or elevators can be employed for moving the bins between the levels. For example, bins are moved from the second to the first level after charging. In one embodiment, prior to having materials dispensed into it, the bin is cleaned. Cleaning can be performed at either level. On the other hand, bins containing processing materials are moved from the first to the second level for charging. The movement of the bin or bins can be achieved by automated transport systems, reducing the likelihood of mix-ups. Automated transport systems can be facilitated by, for example, rails or tracks. Other techniques that can facilitate movement or flow of the bins are also useful. Thus, a bin can be easily moved from one stage to another as well as from one level to another.

As described, the charging of material is facilitated by gravity, thus avoiding the need to use vacuum techniques which increase the likelihood of contamination. Additionally, by providing an inset 364, the filling process can be performed outside the clean room environment. This reduces the traffic movement of products, materials and people within the production corridor, thus minimizing cross contamination. Also, the overall area of the clean room environment can be smaller, which in turn reduces costs. For example, conventional gravity techniques use multi-level production stages for charging equipment in a lower level stage from a higher level stage. Such configuration significantly increases the clean room area needed compared to the present invention.

A buffer zone can optionally be located between the outer wall of the building and the production corridor. The buffer zone is particularly useful for applications in the changes in the production environment can easily impact yields. The buffer zone serves to provide additional insulation between the internal production environment and external building conditions. It also serves as an additional barrier against the entry of insects or other contaminants which can adulterate the products. It can also serve as a security buffer to guard against intrusion and also a safety buffer in the management of products with high toxicity. Where a technical corridor is provided, it can also serve as the buffer zone.

In another embodiment, the production area can comprise one or more additional hubs and production corridors. This can be advantageous since the technical corridor can be shared, enabling more efficient use of space. The different hubs and production corridors can also share production support area as well. Alternatively, a production support area can be associated with each hub and production corridor.

Figure 4:
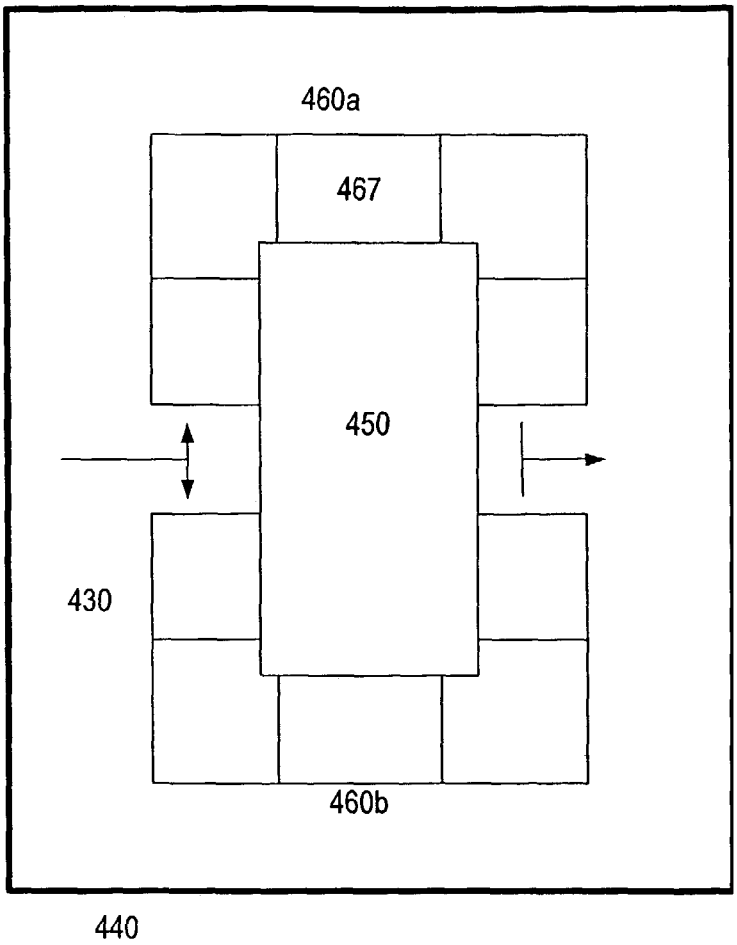
FIG. 4 shows a layout of a production area in accordance with another embodiment of the invention.

FIG. 4 shows another embodiment of a production area 440. As shown, the production area comprises first and second production corridors 460*a-b*, each partially surrounding a common hub 450. Providing other numbers of production corridors which partially surrounds a common hub is also useful. The hub and production corridor can have various geometric shapes. The shape or shapes are preferably selected to optimize the layout of hub and production corridors. The various production corridors can be connected or partially connected to partially or completely surround the hub. Providing one production corridor which partially or completely surrounds the hub is also useful.

A production corridor comprises a plurality of production stages 467 for manufacturing one or more products. Preferably, each production corridor manufactures its respective product or products. Providing production corridors which manufacture the same or some of the same products is also useful. The stages are preferably arranged to optimize production flow, to the extent possible. For example, the production flows in from the left sides of the production area to the production corridors out to the right side of the production area. Other flow arrangements are also useful. In one embodiment, a technical corridor 430 surrounds the production corridors. The technical corridor is shared between the production corridors.

Figure 5:
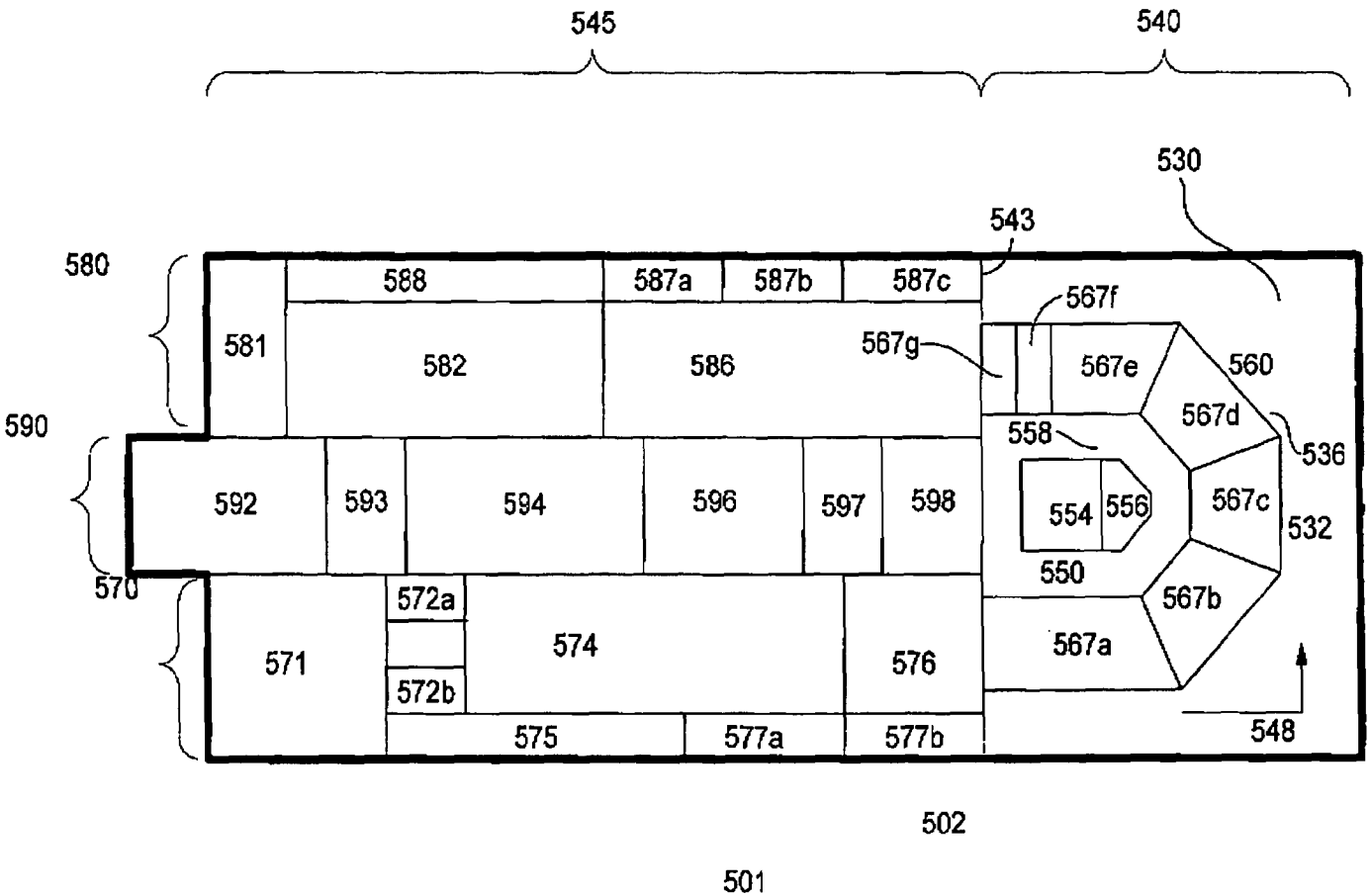
FIGS. 5-6 show a layout of a production facility in accordance with another embodiment of the invention.
Figure 6:
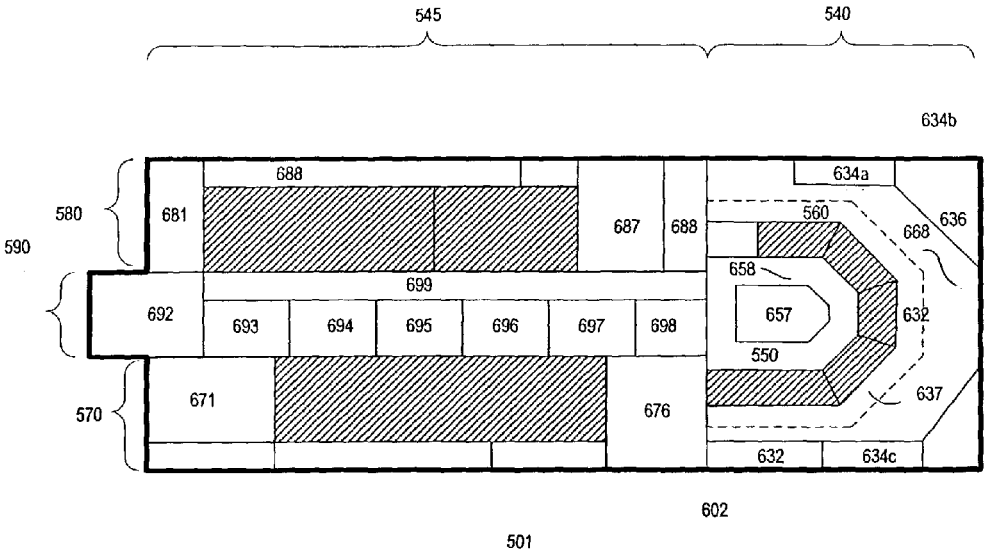

Production support areas can be located on left and right sides of the production area. Other arrangement of the production support area is also useful. For example, the production support area partially or fully surrounds the production area. Alternatively, providing a production support area on one side of the production area is also useful in yet another embodiment of the invention, the production support area can be located in another building. FIGS. 5-6 show a manufacturing facility 501 in accordance with one embodiment of the invention. The facility is designed with a layout for efficient and effective manufacturing of products. Preferably, the facility facilitates efficient and effective manufacturing of pharmaceutical products which is compliant with CGMP and other regulations to which the manufacturing of pharmaceutical products are subjected.

FIG. 5 shows the first level 502 and FIG. 6 shows the second level 602 of the facility. Referring both to FIGS. 5-6, the building comprises a rectangular shape and includes production and production support areas 540 and 545. Lined-filled areas in the second level represent the same areas in the first level (e.g., such areas in the first level have ceilings extending to the top or other levels of the building). Providing a building with other shapes is also useful. In one embodiment, the production support area is on the left side of the building while the production area is on the right side. Each area is also rectangular in shape. Other configurations and/or shapes of the production and production support areas are also useful.

The production area comprises a hub 550. In one embodiment, the hub abuts a boundary 543 of the production and production support areas. In one embodiment, a production corridor partially surrounds the hub and also abuts the boundary of the production and production support areas. The production corridor 560 and hub comprises a semi-octagonal shape. Providing the production corridor and hub with other shapes is also useful. It is also understood that it is not necessary that both the hub and production corridor have the same shape. A technical corridor surrounds the production corridor 530. In one embodiment, the technical corridor is located between the production corridor and boundary of the production area.

The production corridor is separated into a plurality of production stages 567*a*-567*g* for manufacturing one or more products. A processing stage can be used to perform one or more steps in the manufacturing process. For example, stages are used to perform front-end and back-end processes. Some stages, for example, can be duplicated. The sequence of the production stages are preferably arranged to optimize the production process. In one embodiment, the stages are arranged to facilitate flow of work from stage to stage, to the extent possible, in sequence. For example, the sequence of production stages are arranged to facilitate process flow in a counter-clock wise direction, as shown by arrow 548. Arranging the production stages to facilitate process flow in a clockwise direction is also useful.

Preferably, the production stages are used to form one or more pharmaceutical products. In one embodiment, the production corridor is located in a controlled environment. The production stages are physically separated by barriers. The production corridor includes stages 567*a-e* for dispensing processing material, granulation, tableting, tablet coating, and capsule filling. Storage and interlevel stages 567*f-g* are also included in production corridor. The storing stage, for example, temporarily stores processed product for removal for testing and packaging. The interlevel stage, in one embodiment, includes elevator for facilitating movement between first and second levels. An air lock is also included in the interlevel stage to facilitate maintaining the integrity of the controlled environment. Additional or other stages as well as other stage sequence can also be useful.

In a preferred embodiment, the production corridor comprises first and second pseudo levels, as described in FIG. 3. The outer wall of the production corridor on the second level is inset with respect to the outer wall in the first level (indicated by the dotted line 668), creating a step above the first level in the cross-sectional profile of the production corridor. Providing a production corridor with such first and second pseudo levels takes advantage of gravity to charge the production stage equipment from outside the controlled environment of the production corridor. Other techniques or arrangements for charging the production stages are also useful.

Technical corridors 530 are located outside the production corridor in first and second levels of the production area. The technical corridors are preferably between the production corridor and boundary of the production area. Transport areas 536 and 636 are located in technical corridors adjacent the production corridor. Bins, for example, are moved from stage to stage and level to level for charging and discharging of processing or processed materials in the transport areas. Preferably, the bins are transported using an automated transport system.

In one embodiment, washrooms (not shown), if appropriate, are located in the first level access area to facilitate washing of equipment through the wall of the production corridor. The washroom should physically be separated from the clean room environment of the production corridor to reduce contamination. Preferably, airlocks can be provided to enable access between the washroom and production stage. It is understood that not all stages need to be provided with its respective washroom.

The technical corridor can also include, for example, a wash area to clean the bins after use. Stairwells and/or elevators can be included in the technical corridor to facilitate movement between the levels. Additionally, the technical corridor can include technical area between the production area boundary and transport area. The technical area can serve various functions that, for example, support production. For example, the technical area in the second level includes a blending area 637, various plant rooms 634*a-c*, and a wash area 632 for bins. Other types of functions in lieu of and/or in additional those mentioned which support production can also be included in the technical corridors of either and/or both levels, as desired. Preferably, the various support functions are located to optimize process flow.

In one embodiment, a hub 550 abuts the boundary between the production and production support areas and is partially surrounded by the production corridor. Providing a hub which does not abut the boundary between the production and production support areas is also useful. In such case, the production corridor can completely surround the hub. The hub preferably comprises first and second levels corresponding to the first and second levels of the facility. In one embodiment, the first level serves as a workflow hub while the second level serves as a control hub.

The workflow hub preferably is part of the controlled environment of the production corridor. The workflow hub facilitates the flow of products and/or people in the production corridor. In one embodiment, an access corridor 558 is provided in the workflow hub to facilitate flow of people and materials for processing. Preferably, a laboratory 556 is located in the workflow hub to test of the products at various stages of production. Providing the laboratory at the center allows convenient access from the production stages, increasing manufacturing efficiency. A support area 554 can also be provided to serve, for example, as a staging area, work in process storage area and/or support utility area.

The control hub, in one embodiment, is separate from the controlled environment. The control serves as a control area, enabling the manufacturing process to be monitored, identified, and verified easily and efficiently there from. In particular, the control hub has a direct line-of-sight to the production stages. Preferably, a viewing corridor 658 can be provided, enabling the production stages to be visible from the hub. A data center 657 can also be provided to receive manufacturing data from the processing stages. This can be performed in real time or after each process is completed, for example, communication links.

In one embodiment, the production support area comprises inflow and outflow corridors 570 and 580. The inflow corridor comprises various sections for receiving, storing, and preparing materials for production. The various sections are preferably arranged to optimize process flow. For example, the flow of materials can be arranged to flow from one end of the inflow corridor to the other end adjacent to the production area. The outflow corridor comprises sections which receiving, testing, packaging, and storing processed products from the production corridor. Like the inflow corridor, the flow of material can be arranged to flow from one end of the outflow corridor adjacent to the production area to the other end.

In one embodiment, an unloading dock (not shown) is located at a first end of inflow corridor opposite the end adjacent to the production area. Raw materials are delivered and unloaded onto the unloading dock and moved to the receiving section 571. A material sampling section 572*a* can be provided to test the delivered materials to determine whether they are of acceptable quality or not. Accepted materials are moved to raw material storage section 574. Rejected materials are moved to rejected material storage section 572*b* for return to supplier. In a preferred embodiment, the material sampling and rejected material storage sections are located between the receiving and raw material storage sections. A pre-dispensing section 576 is located adjacent the raw material storage section and the production area. Raw materials are moved to the pre-dispensing section in preparation for processing. The sections are preferably arranged from the receiving end of inflow corridor to the end adjacent the production area.

Additional sections, such as inflow support storage, waste collection and waste storage sections 575 and 577*a-b*, can be included in the inflow corridor. The waste storage section should be located adjacent or in close proximity to the production area for receiving waste produced there from. Preferably, the waste collection section should be adjacent to the waste storage section. The inflow support storage is located adjacent or in close proximity to the raw material storage section. Providing the corridor with other sections to facilitate movement of raw material to the production area is also useful. The various sections can be arranged in other configurations. Preferably, the various sections are arranged to facilitate or optimize the flow of raw material to the production area.

In one embodiment, the outflow corridor comprises a loading dock (not shown) located at a first end opposite the end adjacent to the production area. Packaging and finished products storage sections 586 and 582 are also included. The sections are preferably arranged to optimize flow of processed material from the production corridor to shipping of the finished products to customers. For example, processed materials are discharged from the production corridor to a packaging section 586 located adjacent thereto. After the processed materials are packaged, they are stored in a finished product storage section 582. When ready for shipping to customers, the finished products are removed from storage and placed in the dispatched section 581 and loaded into transports (e.g., trucks) for delivery in the loading docks.

Additional sections can be included in the outflow corridor. In one embodiment, packaging and finished product support sections 587-588 are provided. For example, packaging support sections include packaging inspection, packaging supplies, and packaging office sections 587*a-c* to facilitate product packaging. Preferably, the packaging support sections are located adjacent to the packaging section. The finished product support section [purpose] and is preferably located adjacent to the finished product storage section. Other sections can also be included in the outflow corridor, as desired.

In one embodiment, the various sections of the inflow and outflow corridors are arranged to form a U-shaped process flow. Arranging the various section of the corridors or the corridors to produce other process flows, such as straight or L-shaped, are also useful. Preferably, the various sections are arranged to optimize the process flow.

The production support area preferably comprises a second level. The second level of the production support area comprises, for example, support section such as administration and office, cafeteria, and research and development, charge to packing, and training sections 671, 681, 687, 688, and 676. As shown, packaging, finished product storage, and raw material storage sections have their ceilings extending to the top of the second level. Stairwells and/or elevators can be provided to facilitate movement between the levels. Other support sections can also be provided, as desired. The various support sections can be arranged to optimize flow or people and material.

A support corridor 590 can also be provided in the production support area. The support corridor, in one embodiment, is located between the inflow and outflow corridors, forming a spine. The spine can serve as an extension to the hub, performing quality, monitoring functions in the production support area. In a preferred embodiment, the support corridor comprises first and second levels.

In one embodiment, the first level includes an entrance section 592 to the building located at an end of the spine opposite the end abutting the production area. The entrance preferably is a secured entrance to prevent unauthorized entrance to the building. A locker section 593 can be provided adjacent the entrance section, enabling employees to prepare for work. Quality and quality support sections 594 and 596, such as quality test lab and retained samples, are located in the first level. Additional sections 597-598, such as those to support quality or other functions can be included in the support corridor.

The second level can comprises various support sections. In one embodiment, the second level comprises boardroom, training, documentation reproduction and storage, meeting room, miscellaneous storage, clothing storage, and changing sections 692-698. A viewing corridor 699 is also included to enable visual monitoring of the packaging and finished product storage sections of the outflow corridor. Another viewing corridor can also be provided to enable visual monitoring of the inflow corridor. Other support sections can also be provided, as desired in the support corridor.

As described, the various sections of the production support area are arranged to facilitate flow of material and people in sequence. Other arrangements are also useful. Other sections can also be included in addition to or in lieu of sections described. Preferably, the sections are arranged to optimize the flow of people and material in the manufacturing process.

The layout, as described, provides an efficient process flow. For example, work flows along the production corridor while product testing and flow of information are toward the center to the hub area. Furthermore, since the hub has a direct line-of-sight and access to manufacturing data, the layout enables easy monitoring of the manufacturing process, effectively assuring that the flow of materials, people, products are efficient, correct, and verified. The layout also minimizes the number people going through the production corridor (e.g., people can view the production area from the hub without having to enter the production area), facilitating control of the production environment (e.g., temperature, dust, and humidity) and to prevent contamination. This facilitates control of the production environment. Such advantages reduce manufacturing costs by increasing efficiency and reducing errors while being compliant with CGMP.

While the invention has been particularly shown and described with reference to various embodiments, it will be recognized by those skilled in the art that modifications and changes may be made to the present invention without departing from the spirit and scope thereof. The scope of the invention should therefore be determined not with reference to the above description but with reference to the appended claims along with their full scope of equivalents.

What is claimed is:

1. An enclosed production layout comprising:

an enclosed structure comprising a production area and a production support area, the production area abuts the production support area, wherein the production and production support areas are distinct areas within the enclose structure, the production area includes, a hub having an outer boundary with first and second contiguous portions, the first portion abuts the production support area which is within the enclosed structure, wherein the hub is physically separated from a controlled environment of the production area and provides a direct line of sight to monitor manufacturing process in the production area, a production corridor having first and second ends for performing processing, the production corridor completely surrounding the second portion of the hub to form a U-shaped production corridor, the production corridor includes first and second ends abutting the production support area which is within the enclosed structure, wherein the production corridor is enclosed in an environmentally controlled area, wherein the first and second ends facilitates inflow of raw materials for processing from the production support area and outflow of processed goods into the production support area, and a barrier physically separating the environmentally controlled area of the production corridor from the hub, wherein at least a portion of the barrier is transparent to sufficiently enable personnel in the hub to visually monitor the processing in the production corridor without interrupting the environmentally controlled area of the production corridor; and the production support area which is within the enclosed structure serves as an area for storage of material for processing and processed products, the production support area is separated from the controlled environment of the production corridor, the production support area facilitates movement of material into the production area for processing and processed products from the production area for shipping through the first and second ends of the production corridor which abut the production support area.

2. The production layout of claim 1 is for producing at least one pharmaceutical product.

3. The production layout of claim 1 wherein the hub facilitates collection and storing of data from processing.

4. The production layout of claim 1 wherein the production support area comprises inflow and outflow corridors to facilitate the movement of material to the production area and processed products from the production area for shipping.

5. The production layout of claim 4 wherein the production support area further comprises inflow and outflow support corridors, the inflow support corridor supports the movement of material to the production area and the outflow support corridor supports the movement of processed products from the production area for shipping.

6. The production layout of claim 1, 2, 3, 4 or 5 wherein the production area within the enclosed structure further comprises a technical corridor surrounding the production corridor having first and second ends abutting the production corridor, the technical corridor being separated from the environmentally controlled area of the production corridor.

7. An enclosed production layout comprising:

an enclosed structure comprising a production area and a production support area, the production area abuts the production support area, wherein the production and production support areas are distinct areas within the enclose structure, the production area includes a hub having an outer boundary with first and second contiguous portions, the first portion abutting the production support area within the enclosed structure, wherein the hub is physically separated from a controlled environment of the production area and provides a direct line of sight to monitor manufacturing process in the production area, a production corridor for performing processing and includes first and second ends, the production corridor completely surrounds the second portion of the hub to form a U-shaped production corridor, the first and second ends abut the production support area which is within the enclosed structure, wherein the production corridor is enclosed in an environmentally controlled area, and a barrier physically separating the environmentally controlled area of the production corridor from the hub, wherein at least a portion of the barrier is transparent to sufficiently enable personnel in the hub to visually monitor the processing in the production corridor without interrupting the environmentally controlled area of the production corridor; and the production support area which is within the enclosed structure serves as an area for storage of material for processing and processed products, the production support area is separated from the controlled environment of the production corridor, the production support area facilitates movement of material to the production area for processing and processed products from the production area for shipping through the first and second ends of the production corridor which abuts the production support area, the production support area includes a support area abutting the hub, the support area and the hub forming a linear spine in a central portion of the production support area of the enclosed structure.

8. The production layout of claim 7 wherein the production support area comprises inflow and outflow corridors to facilitate the movement of material to the production area and processed products from the production area for shipping.

9. The production layout of claim 8 wherein the production support area further comprises inflow and outflow support corridors, the inflow support corridor supports the movement of material to the production area and the outflow support corridor supports the movement of processed products from the production area for shipping.

10. The production layout of claim 8 wherein the spine comprises areas for critical control and monitoring processes.

11. The production layout of claim 10 wherein the support area includes at least one view sub-corridor.

12. The production layout of claim 7 wherein the spine comprises areas for critical control and monitoring processes.

13. The production layout of claim 7, 8, 9, 10, 11 or 12 wherein the production area within the enclosed structure further comprises a technical corridor surrounding the production corridor, the technical corridor includes first and second ends abutting the production support area and being separated from the environmentally controlled area of the production corridor.

* * * * *